US005186673A

United States Patent [19]

Fogarty et al.

[11] Patent Number: 5,186,673

[45] Date of Patent: Feb. 16, 1993

[54] REMOVABLE CLOTHING IN COMBINATION WITH A DOLL

[76] Inventors: A. Edward Fogarty; Bonnie R. Fogarty, both of 39 Sandy Hook Rd., Sarasota, Fla. 34242

[21] Appl. No.: 882,482

[22] Filed: May 13, 1992

[51] Int. Cl.[5] ..... A63H 3/08; A63H 3/00; A41D 13/00; A41B 13/10

[52] U.S. Cl. ..... 446/98; 446/268; 2/2; 2/52

[58] Field of Search ..... 446/97, 98, 99, 100, 446/101, 268, 321, 387, 388, 472, 474; 2/2, 51, 52, 48, 115; 450/80

[56] References Cited

U.S. PATENT DOCUMENTS

| | | | |
|---|---|---|---|
| 2,673,982 | 4/1954 | Mosen et al. | 2/52 X |
| 2,675,551 | 4/1954 | Ser Vaas | 2/52 |
| 2,709,812 | 6/1955 | Kanzow | 2/52 |
| 2,884,638 | 5/1959 | Ream | 2/52 X |
| 3,093,829 | 6/1963 | Maine | 2/2 |
| 3,204,638 | 9/1965 | Winkler | 450/80 X |
| 3,668,805 | 6/1972 | Coleman | 446/98 |
| 3,753,312 | 8/1973 | Hughes, Jr. | 446/387 |
| 4,639,944 | 2/1987 | Lashley et al. | 2/2 |
| 5,022,886 | 6/1991 | Jenkins | 446/98 X |

*Primary Examiner*—D. Neal Muir
*Attorney, Agent, or Firm*—Charles J. Prescott

[57] ABSTRACT

A three-dimensional fashion doll having removable and interchangeable flexible fabric clothing which simulates the appearance and feel of real clothing. The clothing includes a removable lower body dress or the like having a resilient waistband connected at the corresponding upper end of the dress which biasingly engages around the waist region of the doll to releasably hold the dress in position. Flexible fabric doll clothing for the upper body may be separate having a resilient underjacket which biasingly engages over the doll's shoulders to hold the upper body clothing connected over the resilient jacket in proper position on the doll. The upper body clothing may also be fabricated of stiff, self-supporting fabric structured to cover the frontal upper torso region and supportedly connected at the lower end thereof to the upper end of the lower body clothing.

8 Claims, 3 Drawing Sheets

REMOVABLE CLOTHING IN COMBINATION WITH A DOLL

BACKGROUND OF THE INVENTION

This invention generally relates to fashion dolls for children, and particularly to a three-dimensional fashion doll with removable and interchangeable clothing connectable around the waist of the fashion doll and providing the appearance and feel of real clothing.

Dolls with clothing either in two dimensional or three dimensional form are well known. However, clothing designed to be easily fitted onto a specially designed doll, the clothing made entirely of fabric material to provide a flexible, soft and realistic character is not yet available.

A previous invention of applicants is disclosed in U.S. Pat. No. 4,414,774 which is directed to a fashion and hairstyle doll play set which discloses rigid or semi-rigid molded plastic articles of clothing, hair and hat.

A partially three-dimentional doll is disclosed in U.S. Pat. No. 2,944,368 to O'Brian which teaches clothing fabricated of molded one-piece plastic material which does not completely surround the lower body of the doll and does not provide a realistic look and feel.

Another one-piece rigid plastic clothing arrangement for a play set disclosed in U.S. Pat. No. 4,227,340 to Goldfarb also appears quite unrealistic with respect to both look and feel of the removable rigid clothing.

A kit including a doll, fabric clothing and an installation tool has been invented by Merino as taught in U.S. Pat. No. 4,168,592 which teaches retention of the fabric clothing by forcing by special tool a rear margin of the clothing into molded apertures formed into the back of the doll.

In U.S. Pat. No. 5,021,020 invented by Hambley, a flat toy doll and folio system is there taught, again lacking realism.

A take apart doll with detachable garments is disclosed in U.S. Pat. No. Re. 25,678 to Risler which discloses a rigid plastic dismantleable doll and rigid plastic clothing.

Another rigid plastic clothed doll is disclosed in U.S. Pat. No. 3,939,604 to Nishizawa which is quite dissimilar to the present invention as is the toy figure with accessories disclosed in U.S. Pat. No. 4,185,412 to Rahmstorf, disclosing a toy figure with removable accessories, all of which are fabric of rigid or semi-rigid molded plastic.

The present invention overcomes the above prior art limitations of non-realism by providing a fashion doll with removable clothing, the clothing being fabricated essentially of realistic fabric material and held in place primarily by a resilient plastic waistband which snapingly or biasingly engages around the waist of the doll to retain both lower body and upper body articles of clothing in place. Alternately, the upper body clothing may be fabricated in a similar fashion having a resilient plastic jacket beneath the upper body clothing if desired.

BRIEF SUMMARY OF THE INVENTION

This invention is directed to a three-dimensional fashion doll having removable and interchangeable flexible fabric clothing which simulates the appearance and feel of real clothing. The clothing includes a removable lower body dress or the like having a resilient waistband connected at the corresponding upper end of the dress which biasingly engages around the waist region of the doll to releasably hold the dress in position. Flexible fabric doll clothing for the upper body may be separate having a resilient under-jacket which biasingly engages over the doll's shoulders to hold the upper body clothing connected over the resilient jacket in proper position on the doll. The upper body clothing may also be fabricated of stiff, self-supporting fabric structured to cover the frontal upper torso region and supportedly connected at the lower end thereof to the upper end of the lower body clothing.

It is therefore an object of this invention to provide a fashion doll with removable and interchangeable upper and lower body clothing fabricated essentially of flexible fabric to provide the realistic look and feel of real clothing.

It is yet another object of this invention to provide a fashion doll with easily removable and interchangeable lower and upper body clothing to allow convenient mixing and matching of those articles of doll clothing.

It is yet another object of this invention to provide a fashion doll with easily removable realistic flexible fabic clothing which is held in place on the doll primarily by a resilient waistband which is easily concealed on the unexposed side of the doll clothing.

It is yet another object of this invention to provide a fashion doll with realistic removable clothing, the lower body clothing of which may be fitted into place on the doll by sliding the resilient waistband over the legs and hips of the doll into position.

In accordance with these and other objects which will become apparent hereinafter, the instant invention will now be described with reference to the accompanying drawings.

DETAILED DESCRIPTION OF THE INVENTION

Figure 1:
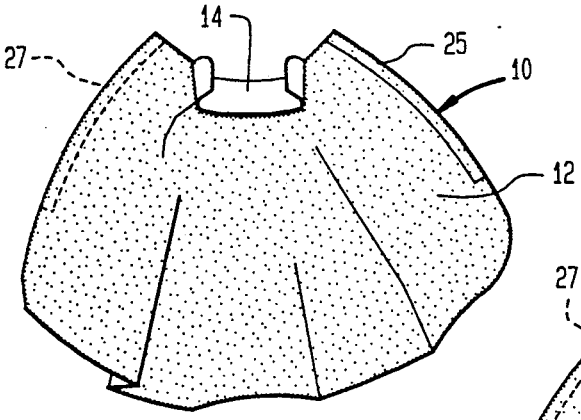
FIG. 1 is a rear perspective view of one embodiment of a removable doll skirt of the present invention.
Figure 2:
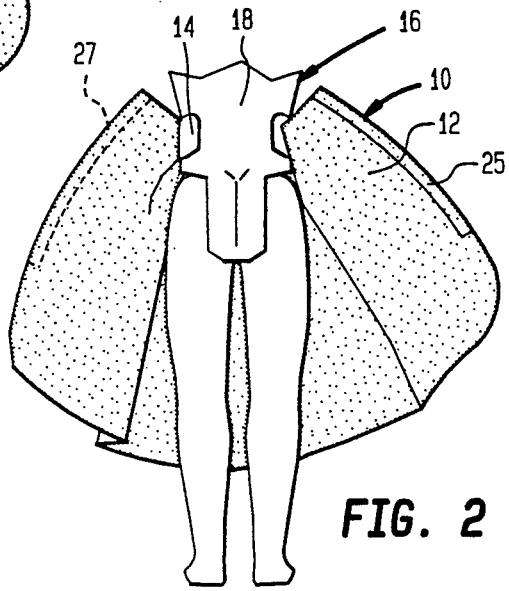
FIG. 2 is a rear view of the lower torso of a fashion doll with the doll skirt of FIG. 1 in position and open from the rear for viewing.

Referring now to the drawings, and particularly to FIGS. 1 to 4, one embodiment of the lower body article of clothing in the form of a doll skirt is shown generally at numeral 10 and includes a flexible fabric panel 12 shaped as an open doll skirt which is connected at its upper margin as by sewing or adhesive to a resilient molded plastic waistband 14. As best seen in FIG. 2, this resilient waistband 14 extends around through more than 180 degrees in circumference and is expandable so as to biasingly engage around the waist region 18 of the fashion doll shown generally at numeral 16.

Figure 3:
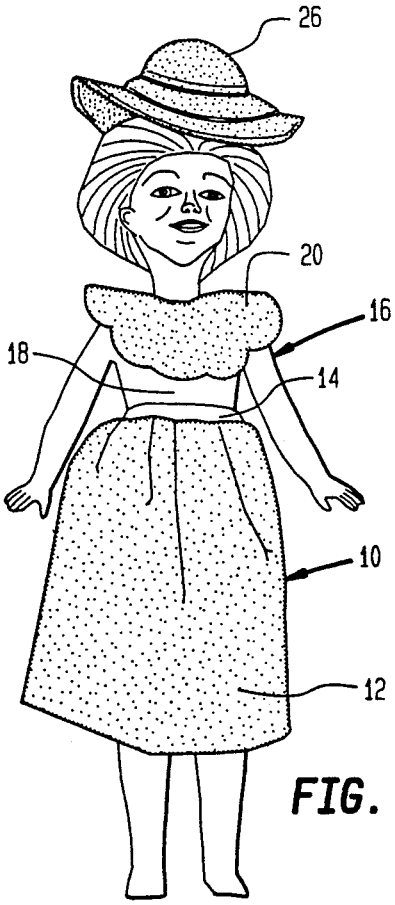
FIG. 3 is a perspective view of the doll in FIG. 2 with upper and lower body clothing and removable hat in position.

After the skirt 10 is positioned as shown in FIG. 2, a pair of mating two part hook and loop strips 25 and 27 connected along a portion of the mating rear upright margins of fabric panel 12 are connectable to fully surround the rear of the doll 16. As seen in FIG. 3, then, the appearance of the skirt 10 on the doll 16 is very realistic both with respect to appearance and feel.

Figure 4:
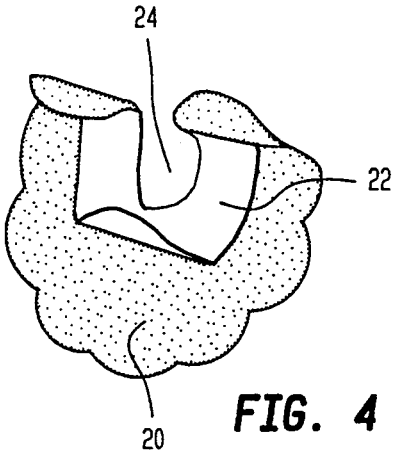
FIG. 4 is a bottom perspective view of the removable upper body clothing shown in FIG. 3.

A separate upper body article of clothing is best seen in FIGS. 3 and 4 an includes a flexible fabric panel 20 which is shaped into the form of a cape of sorts. A resilient molded plastic under jacket 22 having an opening 24 to accommodate the neck region of the doll 16 is connected by stitching or adhesive to the underside of caps 20 and is shaped so as to snapingly engage and be biasingly held in position over the shoulders of the doll 16.

A hat 26, also formed of flexible fabric material and having a generally U-shaped plastic headband connected therebeneath (not shown) is also provided, the resilient headband biasingly engaging over the head of the doll for retention of the hat 26 in proper position as shown in FIG. 3.

Figure 5:
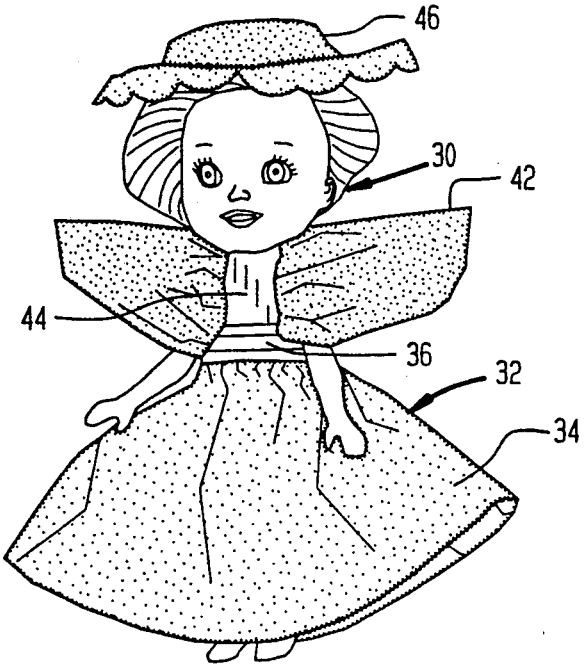
FIG. 5 is a front perspective view of another embodiment of the invention.
Figure 7:
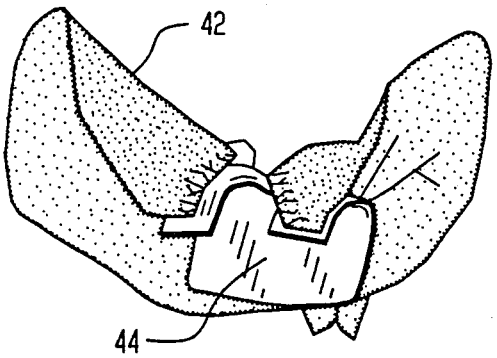
FIG. 7 is a rear perspective view of the removable upper body clothing shown in FIG. 5.
Figure 6:
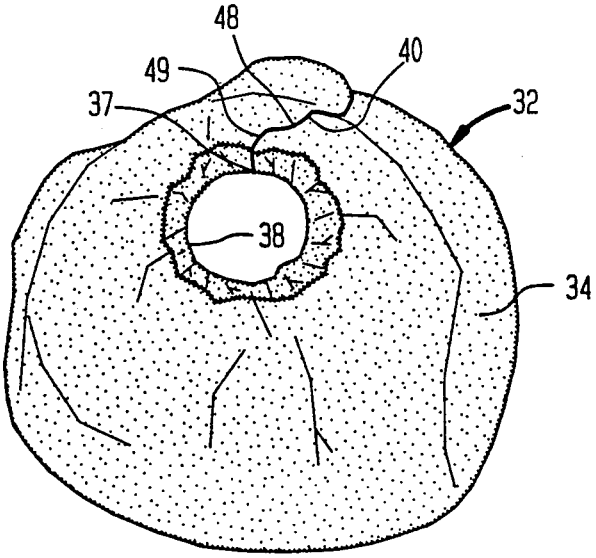
FIG. 6 is a top perspective view of the removable doll skirt shown in FIG. 5.

Referring now to FIGS. 5, 6 and 7, another embodiment of a skirt is shown generally at numeral 32 and is fabricated of a flexible fabric panel 34 formed into the shape of the skirt. A resilient plastic ring 38 formed into a circle through 360 degrees but split at 37, provides the resilient structure necessary to hold the dress 32 in the position shown in FIG. 5, wherein the waist ring 38 snapably engages arond the waist region 36 of doll 30.

In this embodiment of the skirt 32, the lower upright margins of fabric panel 34 are sewn togehter along 40 and terminating at 48. The remaining upper portion of the panel margins 34 is unconnected in the region 49. This is provided so that resilient waist ring 38 may be opened sufficiently so that the skirt 32 may be slidably engaged upwardly over the legs and hips of the doll 30 into the position shown in FIG. 5.

A cape arrangement 42 is also provided having a resilient plastic under jacket 44 for snapable engagement over the upper torso and shoulders of doll 30. Again, fabric panel 42 formed into the shape of the cape is fabricated of flexible fabric material.

A removable hat 46 is again provided having a resilient U-shaped plastic headband (not shown) connected therebeneath so as to allow the secure retention of hat 46 in position, yet provide for the easy removal thereof, while also maintaining a realistic look and feel of a real hat.

Figure 8:
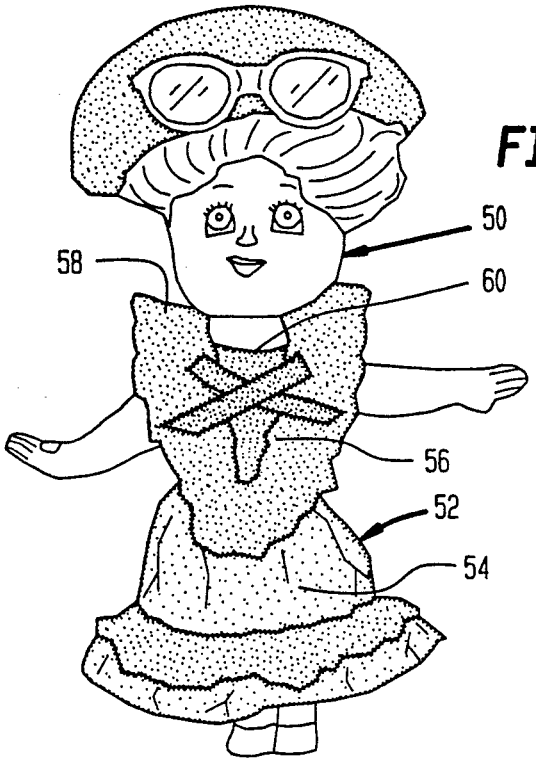
FIG. 8 is a front perspective view of yet another embodiment of the invention.
Figure 10:
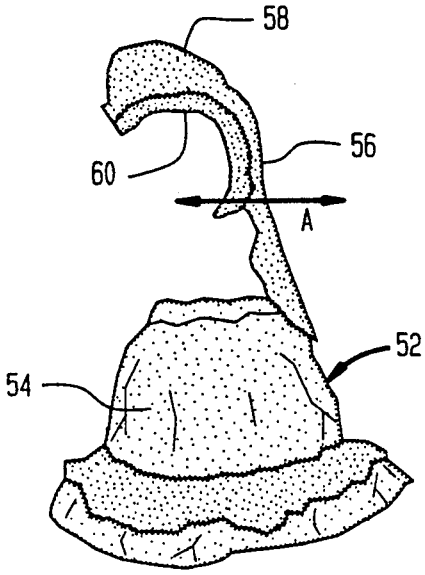
FIG. 10 is a side elevation view of FIG. 9.
Figure 9:
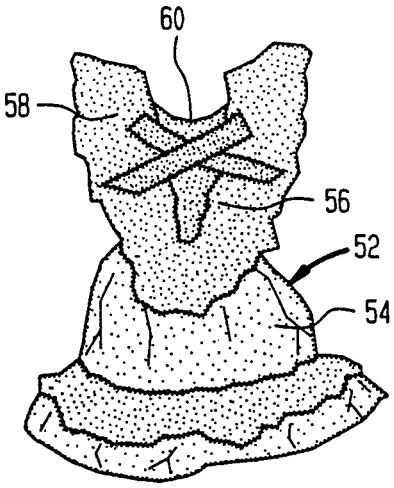
FIG. 9 is a front perspective view of the removable full body doll dress shown in FIG. 8.
Figure 11:
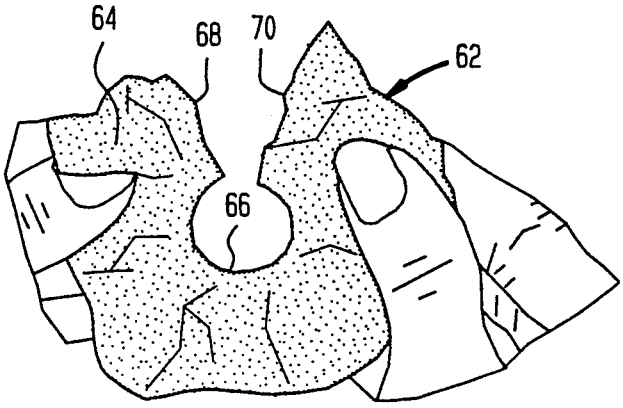
FIG. 11 is a top perspective view of another embodiment of a removable skirt.

Referring now to FIGS. 8, 9 and 10, another embodiment of a full-body dress is shown generally at 52 and includes a skirt portion 54 fabricated of flexible fabric material and having a concealed resilient waistband (not shown) similar to that described with respect to FIG. 11 herebelow. The upper body clothing 56 is provided primarily to cover the frontal area of the upper torso of doll 50. Connected as by sewing or adhesive beneath the upper shoulder region 58 is a resilient plastic under jacket 60 having a neck opening and structured to be supportedly engagable over the shoulders of the doll 50 as previously described. To facilitate installation of the under jacket 60 and to provide realism to the upper clothing 56, the fabric panel extends between the resilient under jacket 60 and the waist region of the skirt 54, allowing easy flexure back and forth in the direction of arrow A. However, when resilient under jacket 60 is positioned over the shoulders of doll 50, the upper clothing 56 is releasably secured in the position shown in FIG. 8. Alternately, the upper clothing 56 may be fabricated of relatively stiff fabric and, by this means, be self-supporting, obviating the need for under jacket 60.

Referring additionally to FIG. 11, a removable skirt is shown generally at 62 and includes structure similar to the dress 52 shown in FIG. 8 through 10. This skirt 62 is fabricated of a flexible fabric panel 64 and is connected to concealed, resilient waist ring 66 which is formed through approximately 360 degrees and split at one point as shown. Margins 68 and 70 are separable by manual spreading thereof as shown, along with resilient waistband 66 to facilitate placing the skirt 62 onto the doll and around the waistband thereof.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. Removable clothing in combination with a doll having three-dimensional body being at least semi-rigid comprising:

a removable article of doll clothing fabricated of flexible fabric which simulates the appearance and feel of an article of real clothing;

said doll clothing including a resilient waistband attached adjacent an upper end of said flexible fabric sized to biasedly engage around a waist of said doll, said waistband removably attaching said doll clothing to said doll;

said flexible fabric separated along a generally upright margin thereof to accommodate engagement of said waistband around said doll waist area;

said margin further including closure means to close said clothing around said doll.

2. A fashion doll with removable clothing as set forth in claim 1, wherein:

said upright margin extends downward from said waistband along the entire length of said lower body clothing.

3. A fashion doll with removable clothing as set forth in claim 1, wherein:

said upright margin extends downward from said waistband only a portion of the length of said lower body clothing.

4. A fashion doll with removable clothing as set forth in claim 1, wherein:

said waistband and the lower body portion of said doll are cooperatively structured to allow said lower body clothing and said waistband to be slid upwardly over the legs and hips of said doll into position around the waist area of the doll.

5. A fashion doll with removable clothing as set forth in claim 1, further comprising:

a removable article of upper body clothing fabricated of flexible fabric structured for covering a front of the upper torso of said doll and which simulates the appearance and feel of an article of real clothing;

said upper body clothing including a resilient upper body jacket therebeneath structured for releasable mating attachment over a shoulder area of said doll.

6. A fashion doll with removable clothing as set forth in claim 5, wherein:

said upper and lower body articles of clothing are connected in the region of said waistband.

7. A fashion doll with removable clothing as set forth in claim 1, further comprising:

a removable article of upper body doll clothing fabricated of self-supporting fabric which simulates the appearance and feel of an article of real clothing;

said upper body clothing connected to and supportedly upwardly extending from said lower body clothing.

8. A fashion doll with removable clothing as set forth in claim 1, further comprising:

a removable doll hat fabricated of flexible fabric which simulates the appearance of a real hat;

said doll hat including a resilient headband connected beneath said hat which flexes open to engage over the head of said doll to removably attach said hat to the head of said doll.

* * * * *